US011845047B2

(12) United States Patent
Price et al.

(10) Patent No.: US 11,845,047 B2
(45) Date of Patent: Dec. 19, 2023

(54) SYSTEMS AND METHODS FOR IMPROVED MIXING

(71) Applicant: Chevron Phillips Chemical Company LP, The Woodlands, TX (US)

(72) Inventors: Ralph J. Price, Porter, TX (US); Kenneth A. Dooley, Porter, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 304 days.

(21) Appl. No.: 15/980,025

(22) Filed: May 15, 2018

(65) Prior Publication Data

US 2019/0351380 A1 Nov. 21, 2019

(51) Int. Cl.
*B01F 27/86* (2022.01)
*B01F 27/1125* (2022.01)
*B01F 35/21* (2022.01)

(52) U.S. Cl.
CPC ..... *B01F 27/86* (2022.01); *B01F 27/1125* (2022.01); *B01F 35/2113* (2022.01); *B01F 35/2115* (2022.01)

(58) Field of Classification Search
CPC ..... B01F 7/1675; B01F 27/86
USPC ..... 366/302, 307; 138/38, 44; 422/228
See application file for complete search history.

(56) References Cited

U.S. PATENT DOCUMENTS 4,887 A * 12/1846 Howd ..... 366/302
73,479 A * 1/1868 Ward ..... B01F 7/1675 366/307
562,296 A * 6/1896 Haley ..... B01F 7/1675 366/307
735,206 A * 8/1903 Burrows ..... B01F 13/0211 366/102
813,918 A * 2/1906 Schmitz ..... F28D 7/106 165/141
814,694 A * 3/1906 Henderson ..... B05B 15/16 239/288.5
2,582,899 A 1/1952 Barnebey et al.
(Continued)

FOREIGN PATENT DOCUMENTS

CN 201669098 U 12/2010
CN 204017728 U 12/2014
(Continued)

OTHER PUBLICATIONS

International Search Report and Written Opinion issued in corresponding application No. PCT/US2019/031009 dated Aug. 12, 2019, 9 pages.
(Continued)

*Primary Examiner* — David L Sorkin
(74) *Attorney, Agent, or Firm* — Eversheds Sutherland (US) LLP

(57) ABSTRACT

Systems and methods for improved mixing, including baffle systems, reactor systems, and methods of using the same are provided herein. These baffle systems include a ring having an exterior surface defining an outer diameter and an outer circumference, an interior surface defining an inner diameter and an inner circumference, a top surface, a bottom surface, and an axis; and one or more substantially vertical baffles extending from the interior surface of the ring toward the axis.

22 Claims, 6 Drawing Sheets
(1 of 6 Drawing Sheet(s) Filed in Color)

(56) References Cited

U.S. PATENT DOCUMENTS 3,319,937 A * 5/1967 Hutton ..... B29B 7/44 366/181.8
3,756,996 A 9/1973 Pugh et al.
4,271,280 A 6/1981 Tomura et al.
4,535,062 A * 8/1985 Muller ..... C12M 27/02 435/297.3
5,078,505 A 1/1992 Nyman et al.
5,188,808 A * 2/1993 Lilja ..... B01D 19/0052 366/307
5,543,477 A 8/1996 Latiolais et al.
5,839,827 A 11/1998 Ogata et al.
6,042,263 A * 3/2000 Mentzer ..... B01F 5/061 138/44
6,769,800 B1 * 8/2004 Young ..... B01F 15/00915 366/306
6,959,589 B1 * 11/2005 Soong ..... G01N 15/06 73/596
7,041,617 B2 5/2006 Jensen et al.
7,056,997 B2 6/2006 Small et al.
8,653,207 B1 2/2014 Salmon et al.
8,960,991 B2 * 2/2015 Vogt ..... B01F 7/00391 366/75
9,302,233 B1 * 4/2016 Lowell ..... B01F 13/00
9,382,348 B2 7/2016 Kufeld et al.
2005/0007875 A1 1/2005 Reinemuth
2006/0043223 A1 * 3/2006 Filgueiras ..... B03B 5/00 241/152.1
2007/0081419 A1 * 4/2007 Mou ..... B01F 7/00241 366/251
2011/0184083 A1 * 7/2011 Vogt ..... B01F 7/00291 523/116

FOREIGN PATENT DOCUMENTS

CN 204107495 U 1/2015
EP 2796192 A2 10/2014

OTHER PUBLICATIONS

Chinese Search Report issued in corresponding CN Application No. 2019800290575, dated Jan. 21, 2022, 3 pages.

* cited by examiner

SYSTEMS AND METHODS FOR IMPROVED MIXING

CROSS-REFERENCE TO RELATED APPLICATIONS

None.

TECHNICAL FIELD OF THE DISCLOSURE

This application relates to systems and methods for improved mixing, in particular to baffle systems and reactor systems and methods of using the same.

BACKGROUND

Many chemical reactors require stirring and mixing to ensure an even distribution of their contents. To improve the mixing in chemical reactors, internal baffles may be added. However, these internal baffles have been unsuitable for high pressure processes, such as low density polyethylene (LDPE) processes, because the attachment means used to attach the baffles to the reactors weaken the reactor's ability to withstand these high pressure conditions. Specifically, ports or bolt holes created to attach internal baffles often become crack initiation points, which lead to stress risers and eventual failure of a component or the entire reactor. Similarly, welding the baffles to the reactor can degrade the integrity of the reactor metal, making it more prone to crack initiation and propagation.

Accordingly, improved systems and methods for improved mixing are needed.

SUMMARY

This summary is provided to introduce various concepts in a simplified form that are further described below in the detailed description. This summary is not intended to identify required or essential features of the claimed subject matter nor is the summary intended to limit the scope of the claimed subject matter.

This summary and the following detailed description provide examples and are explanatory only of the invention. Accordingly, the foregoing summary and the following detailed description should not be considered to be restrictive. Additional features or variations thereof can be provided in addition to those set forth herein, such as for example, various feature combinations and sub-combinations of these described in the detailed description.

In one aspect, a baffle system for improved mixing in a cylindrical reactor is provided, the baffle system including: a ring having an exterior surface defining an outer diameter and an outer circumference, an interior surface defining an inner diameter and an inner circumference, a top surface, a bottom surface, and an axis; and one or more substantially vertical baffles extending from the interior surface of the ring toward the axis; wherein the ring is continuous or discontinuous along the outer circumference, the inner circumference, or both the outer circumference and the inner circumference.

In another aspect, a reactor system is provided, the reactor system including: a cylindrical reactor having an inner surface and an outer surface; and the baffle system of claim 1 installed inside the reactor, such that the exterior surface of the ring is in contact with the inner surface of the reactor.

In yet another aspect, a method of improving mixing in a gas phase, a liquid phase, a supercritical, or a slurry process is provided, the method including: installing a baffle system inside a substantially cylindrical reactor having an outer surface and an inner surface; wherein the baffle system includes: (a) a ring having an exterior surface defining an outer diameter and an outer circumference, an interior surface defining an inner diameter and an inner circumference, a top surface, a bottom surface, and an axis, wherein the ring is continuous or discontinuous along the outer circumference, the inner circumference, or both the outer circumference and the inner circumference; and (b) one or more substantially vertical baffles extending from the interior surface of the ring toward the axis; and wherein, when installed, the exterior surface of the ring is in contact with the inner surface of the reactor; and under gas phase, liquid phase, supercritical phase, or slurry process conditions, stirring the contents of the cylindrical reactor.

These and other aspects and embodiments according to this disclosure are provided in the drawings, detailed description and claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following figures form part of the present specification and are included to further demonstrate certain aspects of the present disclosure. The invention may be better understood by reference to one or more of these figures in combination with the detailed description of specific aspects presented herein.

Figure 1:
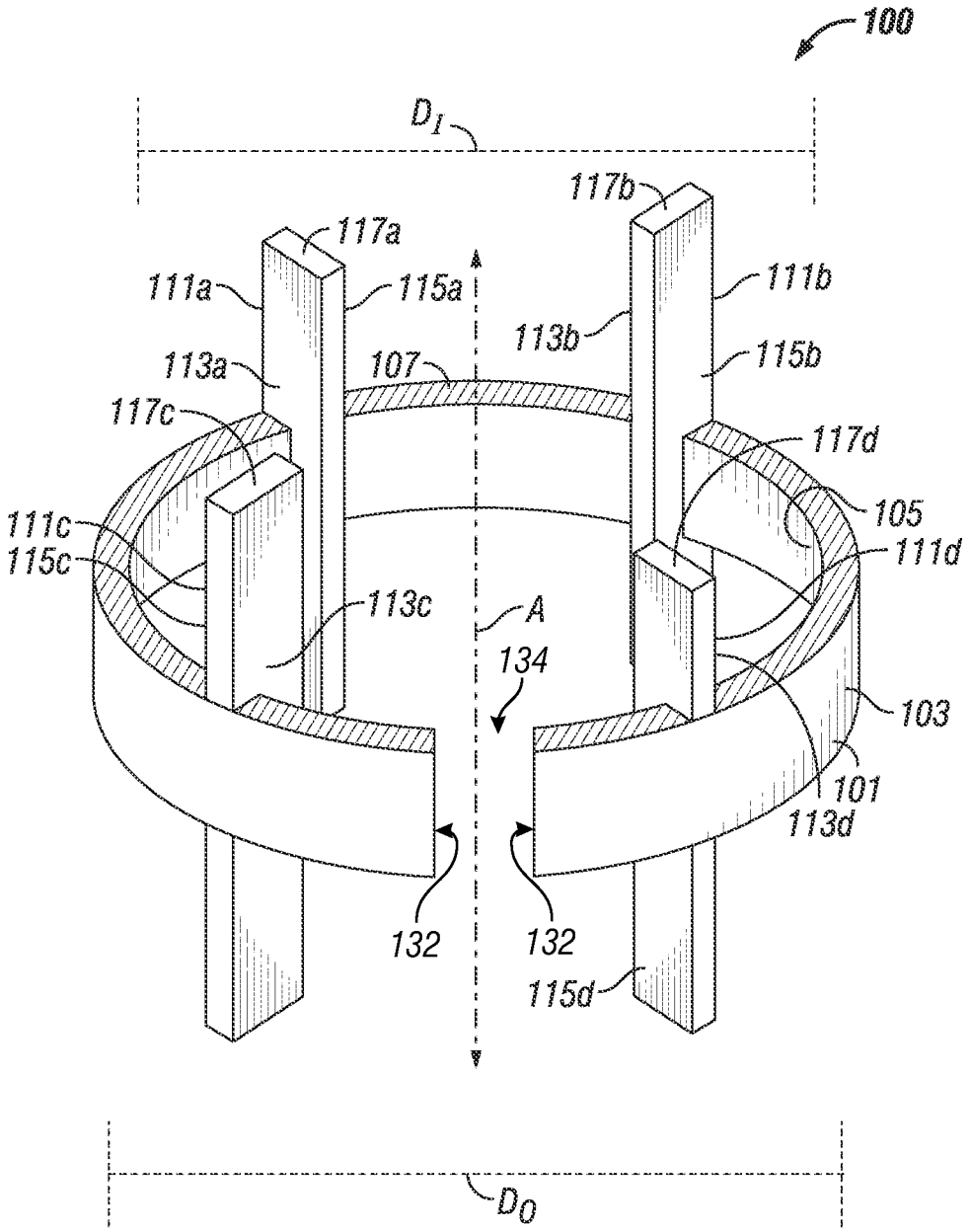
FIG. 1 illustrates a perspective view of a baffle system according to an aspect of the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DEFINITIONS

The following definitions are provided in order to aid those skilled in the art in understanding the detailed description of the present invention. Unless otherwise defined herein, scientific and technical terms used in connection with the present invention shall have the meanings that are commonly understood by those of ordinary skill in the art to which this invention belongs, and unless otherwise indicated or the context requires otherwise, these definitions are applicable throughout this disclosure. Further, unless otherwise required by context, singular terms shall include pluralities and plural terms shall include the singular. For example, if a term is used in this disclosure but is not specifically defined herein, the definition from the IUPAC Compendium of Chemical Terminology, 2nd Ed (1997) can be applied, as long as that definition does not conflict with any other disclosure or definition applied herein, or render indefinite or non-enabled any claim to which that definition is applied. To the extent that any definition or usage provided by any document incorporated herein by reference conflicts with the definition or usage provided herein, the definition or usage provided herein controls.

Unless explicitly stated otherwise in defined circumstances, all percentages, parts, ratios, and like amounts used herein are defined by weight.

Further, in this connection, certain features of the invention which are, for clarity, described herein in the context of separate aspects, may also be provided in combination in a single aspect. Conversely, various features of the invention that are, for brevity, described in the context of a single aspect, may also be provided separately or in any subcombination.

Regarding claim transitional terms or phrases, the transitional term "comprising", which is synonymous with "including", "containing", or "characterized by" is inclusive or open-ended and does not exclude additional, un-recited elements or method steps. The transitional phrase "consisting of" excludes any element, step, or ingredient not specified in the claim. The transitional phrase "consisting essentially of" limits the scope of a claim to the specified materials or steps and those that do not materially affect the basic and novel characteristic(s) of the claimed invention. A "consisting essentially of" claim occupies a middle ground between closed claims that are written in a "consisting of" format and fully open claims that are drafted in a "comprising" format. Absent an indication to the contrary, when describing a compound or composition "consisting essentially of" is not to be construed as "comprising," but is intended to describe the recited component that includes materials which do not significantly alter composition or method to which the term is applied. For example, a feedstock consisting essentially of a material A can include impurities typically present in a commercially produced or commercially available sample of the recited compound or composition. When a claim includes different features and/or feature classes (for example, a method step, feedstock features, and/or product features, among other possibilities), the transitional terms comprising, consisting essentially of, and consisting of, apply only to the feature class to which is utilized and it is possible to have different transitional terms or phrases utilized with different features within a claim. For example, a method can comprise several recited steps (and other non-recited steps) but utilize a catalyst system preparation consisting of specific steps and utilize a catalyst system comprising recited components and other non-recited components. While compositions and methods are described in terms of "comprising" various components or steps, the compositions and methods can also "consist essentially of" or "consist of" the various components or steps.

The articles "a" and "an" may be employed in connection with various elements and components of compositions, processes or structures described herein. This is merely for convenience and to give a general sense of the compositions, processes or structures. Such a description includes "one or at least one" of the elements or components. Moreover, as used herein, the singular articles also include a description of a plurality of elements or components, unless it is apparent from a specific context that the plural is excluded.

As used herein, "LDPE" or "low density polyethylene" is used broadly to refer to polyethylene having a standard density of from about 0.910 g/cm$^3$ to about 0.925 g/cm$^3$, as described in ASTM D 883-17.

"Optional" or "optionally" means that the subsequently described event or circumstance can or cannot occur, and that the description includes instances where the event or circumstance occurs and instances where it does not.

As used herein, "substantially vertical" is used broadly to refer to articles which are from about 0° to about 45° from vertical, for example, about 0° from vertical, about 5° from vertical, about 10° from vertical, about 15° from vertical, about 20° from vertical, about 25° from vertical, about 30° from vertical, about 35° from vertical, about 40° from vertical, about 45° from vertical, and any ranges therebetween. As used herein, the term "vertical" when used to refer to a structure within a ring or a reactor means a direction that is parallel to the central axis of the ring or reactor.

As used herein, "substantially perpendicular" is used broadly to refer to surfaces which are about 90° from one another, for example about 120° from one another, about 110° from one another, about 100° from one another, about 90° from one another, about 80° from one another, about 70° from one another, about 60° from one another, and any ranges therebetween.

As used herein, a ring which is "continuous" along the outer circumference is used broadly to refer to a ring having a cross-section perpendicular to the axis of the ring which forms an uninterrupted ring. As used herein, a "continuous" ring includes rings which have some cross-sections which do not form an uninterrupted ring, such as rings which contain one or more notches or apertures.

As used herein, a ring which is "discontinuous" along the outer circumference is used broadly to refer to a ring which does not have any cross-section perpendicular to the axis of the ring which forms an uninterrupted ring.

The terms "configured for use" or "adapted for use" and similar language is used herein to reflect that the particular recited structure or procedure is used in a system or process as disclosed herein. For example, unless otherwise specified, a particular structure "configured for use" means it is "configured for use in a reactor system", including for example, "configured for use in an olefin polymerization reactor system" and therefore is designed, shaped, arranged, constructed, and/or tailored to effect olefin polymerization, as would have been understood by the skilled person.

The term "olefin" is used herein in accordance with the definition specified by IUPAC: acyclic and cyclic hydrocarbons having one or more carbon-carbon double bonds apart from the formal ones in aromatic compounds. The class "olefins" subsumes alkenes and cycloalkenes and the corresponding polyenes. Ethylene, propylene, 1-butene, 2-butene, 1-hexene and the like are non-limiting examples of olefins.

The term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. The term "about" also encompasses amounts that differ due to different equilibrium conditions for a composition resulting from a particular initial mixture. Whether or not modified by the term "about", the claims include equivalents to the quantities. The term "about" may mean within 10% of the reported numerical value, or within 5% of the reported numerical value, or within 2% of the reported numerical value.

As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but may include other elements not expressly listed or inherent to such composition, mixture, process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial aspect of the inventions are described or shown for the sake of clarity and understanding. Persons of skill in this art will also appreciate that the development of an actual commercial aspect incorporating aspects of the present inventions will require numerous implementation-specific decisions to achieve the developer's ultimate goal for the commercial aspect. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Baffle Systems

Baffle systems for improved mixing in cylindrical reactors are provided herein. In some aspects, the baffle system includes a ring having an exterior surface defining an outer diameter and an outer circumference, an interior surface defining an inner diameter and an inner circumference, a top surface, a bottom surface, and an axis. The baffle system further includes one or more substantially vertical baffles extending from the interior surface of the ring toward the axis. In some aspects, the ring is continuous along the outer circumference and the inner circumference. In some aspects, the ring is continuous along one of the outer circumference or inner circumference. In some aspects, the ring is discontinuous along one or more of the outer circumference and the inner circumference.

In some aspects, the baffle system includes two or more substantially vertical baffles, for example 2 substantially vertical baffles, 3 substantially vertical baffles, 4 substantially vertical baffles, 5 substantially vertical baffles, 6 substantially vertical baffles, 7 substantially vertical baffles, 8 substantially vertical baffles, 9 substantially vertical baffles, 10 substantially vertical baffles, and the like.

In some aspects, one or more of the substantially vertical baffles has a length which extends vertically above the top surface of the ring, vertically below the bottom surface of the ring, or both. In some aspects, none of the substantially vertical baffles has a length which extends vertically above the top surface of the ring or vertically below the bottom surface of the ring.

In some aspects, one or more of the substantially vertical baffles are planar and include a first planar surface and a second planar surface, each of which is perpendicular to the interior surface of the ring and at least one lateral surface connecting the first planar surface and the second planar surface. The first planar surface and second planar surface may be any suitable shape. In some aspects, the first planar surface and the second planar surface are polygonal in shape, for example rectangular or trapezoidal in shape. In some aspects, the first planar surface and the second planar surface include one or more rounded corners. In some aspects, the baffle system includes two or more substantially vertical baffles having first planar surfaces and second planar surfaces of two or more different shapes.

In some aspects, the ring is configured to extend from a bottom head of the cylindrical reactor to a motor housing of the cylindrical reactor. In some aspects, the ring includes one or more openings extending from the exterior surface of the ring to the interior surface of the ring and located along the outer circumference of the ring to correspond to one or more feed inlet ports, outlet ports, or measuring device ports of the reactor. In some aspects, the ring further includes one or more projections extending outwardly from the exterior surface of the ring, each projection comprising an aperture extending through the projection to the interior surface of the ring, and located along the outer circumference of the ring to correspond to and extend into one or more feed inlet ports, outlet ports, or measuring device ports of the reactor. In some aspects, the one or more projections stabilize the ring within the cylindrical reactor, making the baffle system less likely to shift within the cylindrical reactor than a comparative baffle system without the projections. In some aspects, the ring is further configured to be attached to the cylindrical reactor by one or more bolts, welding, or any combination thereof.

In some aspects, the ring is a compression ring. For example, in some aspects the ring may be discontinuous, such that in a relaxed state the ring may have an outer diameter larger than the inner diameter of a cylindrical reactor but the ring may be compressed to have an outer diameter smaller than the inner diameter of a cylindrical reactor. The ring may then be installed within the cylindrical reactor in its compressed state and allowed to expand toward its relaxed state once installed within the cylindrical reactor.

In this way, the compression ring may exert a constant force against the inner surface of the cylindrical reactor, keeping it in place. In some aspects, the compression ring is configured to maintain the baffle system in place in the cylindrical reactor without other attachment means.

In some aspects, the ring is an interference fit ring. For example, in some aspects the ring is configured to form a press fit or friction fit with an inner surface of a cylindrical reactor. In some aspects, the interference fit ring can be forced into place within the cylindrical reactor. In some aspects, the interference fit ring may have an outer diameter which is about equal to the inner diameter of a cylindrical reactor when the interference fit ring and the cylindrical reactor are at the same temperature, and a temperature change may be used to effect a change in one or more of the outer diameter of the interference fit ring and the inner diameter of the cylindrical reactor. For example, in some aspects, the interference fit ring may be cooled, such that the interference fit ring contracts and the outer diameter of the interference fit ring becomes smaller than the inner diameter of the cylindrical reactor. In some aspects, the cylindrical reactor may be heated such that the inner diameter of the cylindrical reactor becomes larger than the outer diameter of the interference fit ring. In some aspects, a temperature change is effected on one or more of the interference fit ring and the cylindrical reactor before the baffle system is installed in the cylindrical reactor. In some aspects, the interference fit ring is configured to maintain the baffle system in place in the cylindrical reactor without other attachment means.

In some aspects, the ring is configured to be attached to the cylindrical reactor in one or more of a bearing housing or a motor seal block.

In some aspects, the top surface of the ring is configured to support a mixing motor housing. For example, in some aspects, the top surface of the ring is configured to solely support a mixing motor housing, without the need to otherwise attach the mixing motor housing to the cylindrical reactor.

The baffle system may be made of any suitable material. For example, in some aspects one or more of the ring and the one or more baffles are made of steel. For example, in some aspects the ring and the one or more baffles are made of steel.

In some aspects, the length of the one or more substantially vertical baffles is determined relative to the outer diameter of the ring. For example, in some aspects, the length of the one or more substantially vertical baffles is from about 0.1 times to about 10 times the outer diameter of the ring, for example about 0.1 times the outer diameter of the ring, about 0.5 times the outer diameter of the ring, about 1 times the outer diameter of the ring, about 2 times the outer diameter of the ring, about 3 times the outer diameter of the ring, about 4 times the outer diameter of the ring, about 5 times the outer diameter of the ring, about 6 times the outer diameter of the ring, about 7 times the outer diameter of the ring, about 8 times the outer diameter of the ring, about 9 times the outer diameter of the ring, about 10 times the outer diameter of the ring, and any ranges therebetween.

In some aspects, the length of the one or more substantially vertical baffles is determined relative to the outer diameter of the ring divided by the revolutions per second made by a stirrer in the reactor. That is, in some aspects, the length of the substantially vertical baffles is determined relative to the outer diameter of the ring divided by speed at which a stirrer in the reactor is designed to rotate in revolutions per second. For example, in some aspects, the one or more substantially vertical baffles has a length of from about 0.1 times to about 100 times the outer diameter of the ring divided by the revolutions per second made by a stirrer in the reactor, for example about 0.1 times, about 0.5 times, about 1 times, about 10 times, about 20 times, about 30 times, about 40 times, about 50 times, about 60 times, about 70 times, about 80 times, about 90 times, about 100 times the outer diameter of the ring divided by the revolutions per second made by a stirrer in the reactor, or any ranges therebetween.

Reactor Systems and Methods of Improving Mixing

Reactor systems for improved mixing are provided herein. In some aspects, a reactor system is provided including a cylindrical reactor having an inner surface and an outer surface; and any of the baffle systems described above installed inside the reactor, such that the exterior surface of the ring is in contact with the inner surface of the reactor.

In some aspects, the cylindrical reactor is a tubular reactor or an autoclave reactor. For example, in some aspects, the cylindrical reactor is a high pressure autoclave LDPE reactor. In some aspects, the reactor is a high pressure LDPE reactor. In some aspects, the reactor may be a polymerization reactor as disclosed in U.S. Pat. No. 9,382,348, which is hereby incorporated herein by reference. In some aspects, the reactor is configured to contain a gas phase, a liquid phase, a supercritical, or a slurry process. In some aspects, the reactor is configured to produce polyethylene or ethylene copolymers, as disclosed in U.S. Pat. Nos. 3,756,996 and 5,543,477, which are each hereby incorporated herein by reference. In some aspects, one or more of the cylindrical reactor, the ring, and the one or more substantially vertical baffles are made from steel.

In some aspects, the length of the one or more substantially vertical baffles extends substantially vertically along and in contact with the inner surface of the cylindrical reactor.

In some aspects, the reactor system includes a motor including an axial shaft extending vertically through the center and along the axis of the ring and having at least two vanes extending from the axial shaft. For example, in some aspects, the axial shaft has two vanes, three vanes, four vanes, five vanes, six vanes, seven vanes, eight vanes, nine vanes, ten vanes, eleven vanes, twelve vanes, thirteen vanes, fourteen vanes, or fifteen vanes extending from the axial shaft. When in use, the motor may rotate the axial shaft, causing the at least two vanes to rotate about the axis of the ring and mix the contents of the reactor. In some aspects, the at least two vanes are located vertically along the axial shaft such that at least a portion of the vanes is between the top surface and the bottom surface of the ring. In these aspects, the one or more substantially vertical baffles may convert the largely tangential velocities which are imparted by the at least two vanes into axial and radial currents. The addition of these axial and radial currents within the reactor serves to greatly improve the mixing within the reactor beyond what is achievable with the at least two vanes without the stationary baffles.

In some aspects, the reactor system includes one or more of a feed inlet port, an outlet port, and a measuring device port. The feed inlet port may be configured to receive a feedstock. For example, the feed inlet port may be configured to receive olefin monomers, such as ethylene, propylene, or any combinations thereof. In some aspects, the reactor may be configured to receive one or more catalysts, for example one or more polymerization catalysts, such as the catalysts disclosed in U.S. Pat. Nos. 7,041,617 and 7,056,997, which are hereby incorporated herein in their entirety. In some aspects, the reactor may be configured to receive one or more initiators, such as those disclosed in U.S. Pat. Nos. 4,271,280, and 8,653,207, which are each hereby incorporated herein by reference. In some aspects, the reactor may be configured to receive one or more catalysts through the feed inlet port. In some aspects, the reactor may further include a catalyst port configured to receive one or more catalysts. The outlet port may be configured to allow reactor products to exit the reactor. For example, in some aspects the outlet port may be configured to allow polyolefins, such as polyethylene, polypropylene, or any combinations thereof to exit the reactor. In some aspects, the outlet port may be operatively connected to the feed inlet port of another reactor. In some aspects, the outlet port may be operatively connected to further processing equipment. In some aspects, the reactor system includes one or more measuring device ports. For example, in some aspects, the one or more measuring device ports may be configured to allow one or more thermocouples to extend into the reactor, to measure the temperature of the reactor contents. In some aspects, the one or more measuring device ports may be configured to allow one or more pressure sensors to extend into the reactor, to measure the pressure of the reactor contents. In some aspects, the reactor may include two or more measuring device ports, wherein one or more of the measuring device ports is configured to allow one or more thermocouples to extend into the reactor, to measure the temperature of the reactor contents, and wherein one or more of the measuring device ports is configured to allow one or more pressure sensors to extend into the reactor, to measure the pressure of the reactor contents.

In some aspects, the ring further includes one or more openings extending from the exterior surface of the ring to the interior surface of the ring and located along the outer circumference of the ring to correspond to one or more feed inlet ports, outlet ports, or measuring device ports of the reactor. In these aspects, the ring advantageously allows the reactor feedstock, reactor products, and measuring devices to extend through the ring into the reactor.

In some aspects, the ring further includes one or more projections extending outwardly from the exterior surface of the ring, each projection having an aperture and located along the outer circumference of the ring to correspond to and extend into one or more feed inlet ports, outlet ports, or measuring device ports of the reactor. In these aspects, each projection advantageously serves both to allow the reactor feedstock, reactor products, and measuring devices to extend through the ring into the reactor, and to assist in keeping the ring in place within the reactor, without the need for mechanical fasteners which may lead to crack propagation and reactor failure.

In some aspects, the length of the one or more substantially vertical baffles is determined relative to the outer diameter of the ring. For example, in some aspects, the length of the one or more substantially vertical baffles is from about 0.1 times to about 10 times the outer diameter of the ring, for example about 0.1 times the outer diameter of the ring, about 0.5 times the outer diameter of the ring, about 1 times the outer diameter of the ring, about 2 times the outer diameter of the ring, about 3 times the outer diameter of the ring, about 4 times the outer diameter of the ring, about 5 times the outer diameter of the ring, about 6 times the outer diameter of the ring, about 7 times the outer diameter of the ring, about 8 times the outer diameter of the ring, about 9 times the outer diameter of the ring, about 10 times the outer diameter of the ring, and any ranges therebetween.

In some aspects, the length of the one or more substantially vertical baffles is determined relative to the outer diameter of the ring divided by the revolutions per second made by a stirrer in the reactor. That is, in some aspects, the length of the substantially vertical baffles is determined relative to the outer diameter of the ring divided by speed at which the two or more vanes in the reactor are designed to rotate in revolutions per second. For example, in some aspects, the one or more substantially vertical baffles has a length of from about 0.1 times to about 100 times the outer diameter of the ring divided by the revolutions per second made by a stirrer in the reactor, for example about 0.1 times, about 0.5 times, about 1 times, about 10 times, about 20 times, about 30 times, about 40 times, about 50 times, about 60 times, about 70 times, about 80 times, about 90 times, about 100 times the outer diameter of the ring divided by the revolutions per second made by a stirrer in the reactor, or any ranges therebetween.

In some aspects, the ring is further attached to the cylindrical reactor. For example, in some aspects, the ring is further attached to the cylindrical reactor in one or more of a bearing housing or a motor seal block. In some aspects, the ring may be attached to the cylindrical reactor by one or more bolts, welding, or any combination thereof. Even where one or more bolts, welding, or a combination thereof is used, however, fewer bolts or welding spots may be needed than other baffle systems. In this way, even though the bolts or welding may lead to crack propagation or reactor failure, because fewer points of weakness may be introduced, reactor systems including the baffle systems described above are less likely to lead to crack propagation or reactor failure than other baffle systems.

Methods of improving mixing are provided herein. In some aspects, a method of improving mixing in a gas phase, a liquid phase, a supercritical, or a slurry process is provided, the method including: installing any of the baffle systems described above inside a substantially cylindrical reactor having an outer surface and an inner surface, wherein, when installed, the exterior surface of the ring is in contact with the inner surface of the reactor; and under gas phase, liquid phase, supercritical phase, or slurry process conditions, stirring the contents of the cylindrical reactor. In some aspects, the reactor system includes a motor including an axial shaft extending vertically through the center and along the axis of the ring and having at least two vanes extending from the axial shaft; and the step of stirring the contents of the cylindrical reactor includes running the motor to rotate the axial shaft and the at least two vanes extending from the axial shaft about the axis of the ring to stir the contents of the cylindrical reactor.

In some aspects, the method further includes installing a motor in the substantially cylindrical reactor such that the motor rests on the top surface of the ring, the motor having an axial shaft extending vertically through the center and along the axis of the ring and comprising at least two vanes extending from the axial shaft.

Illustrated Aspects

FIG. 1 illustrates a perspective view of a baffle system 100 according to an aspect of the present disclosure. The baffle system 100 includes a discontinuous ring 101 surrounding a central longitudinal axis A that defines an axial center of the baffle system and having an exterior surface 103 having an outer diameter Do, an interior surface 105 having an inner diameter $D_I$, a top surface 107, a bottom surface 109. The discontinuous ring 101 is a compression ring having two opposing and non-overlying edges 132 and a gap 134 therebetween. The interior surface 105 defines an inner circumference, and the exterior surface 103 defines an outer circumference. The baffle system 100 further includes several substantially vertical baffles 111*a*, 111*b*, 111*c*, and 111*d* extending from the interior surface 105 of the ring 101 toward the central axis A. Each of the substantially vertical baffles 111*a*, 111*b*, 111*c*, and 111*d* has a first planar surface 113*a*, 113*b*, 113*c*, and 113*d*, a second planar surface 115*a*, 115*b*, 115*c*, and 115*d*, and at least one lateral surface 117*a*, 117*b*, 117*c*, and 117*d* connecting the first planar surface 113*a*, 113*b*, 113*c*, and 113*d* and the second planar surface 115*a*, 115*b*, 115*c*, and 115*d* of each of the substantially vertical baffles 111*a*, 111*b*, 111*c*, and 111*d*, respectively. As shown in FIG. 1, each of the substantially vertical baffles 111*a*, 111*b*, 111*c*, and 111*d* is the shape of a rectangular prism and has a length such that each of the substantially vertical baffles 111*a*, 111*b*, 111*c*, and 111*d* extends above the top surface 107 of the ring 101 and below the bottom surface 109 of the ring in an axial direction.

Figure 2:
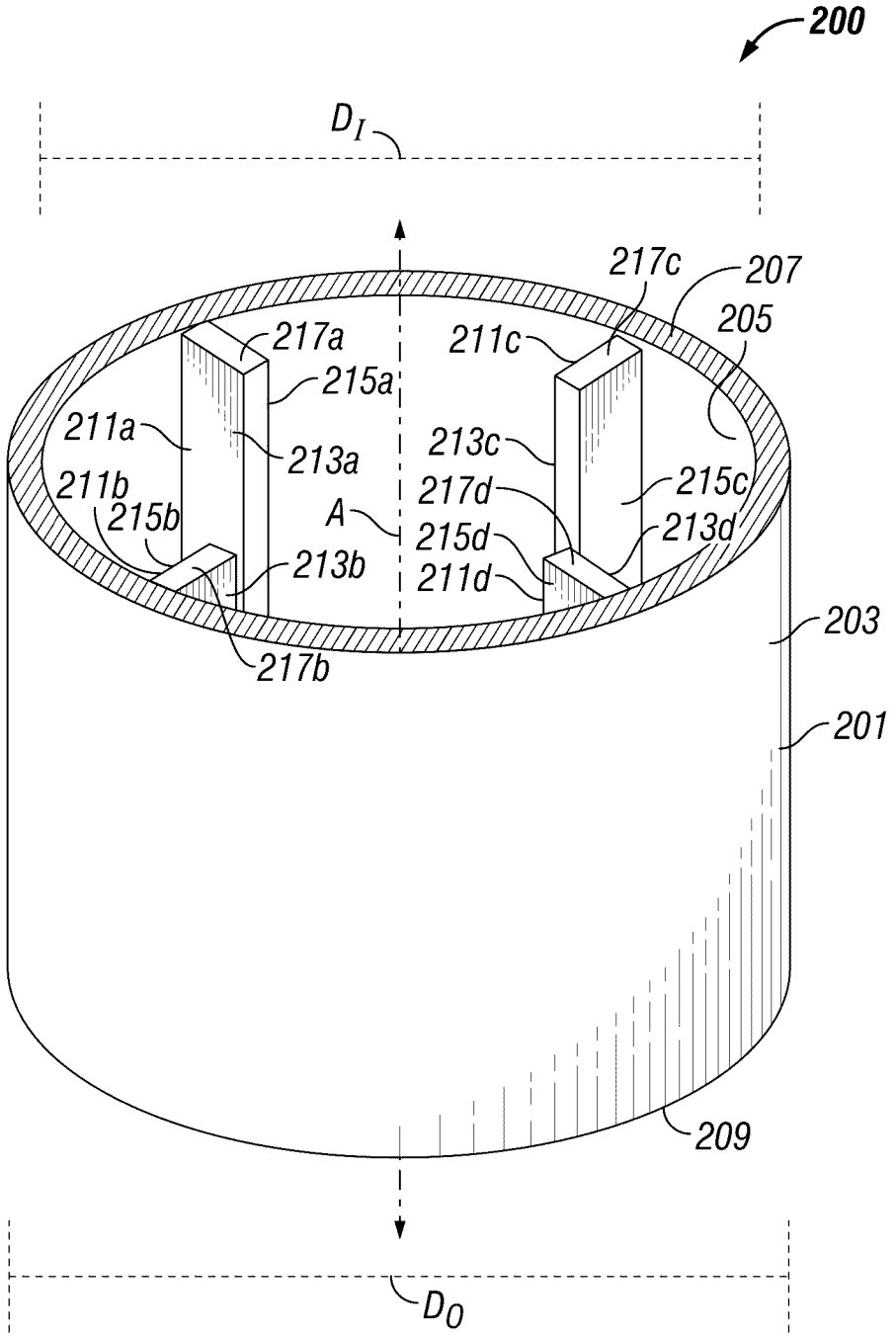
FIG. 2 illustrates a perspective view of a baffle system according to another aspect of the present disclosure.

FIG. 2 illustrates a perspective view of a baffle system 200 according to another aspect of the present disclosure. The baffle system 200 includes a continuous ring 201 surrounding a central axis A and having an exterior surface 203 having an outer diameter $D_O$, an interior surface 205 having an inner diameter $D_I$, a top surface 207, a bottom surface 209. The continuous ring 201 is an interference fit ring. The interior surface 205 defines an inner circumference, and the exterior surface 203 defines an outer circumference. The baffle system 200 further includes several substantially vertical baffles 211*a*, 211*b*, 211*c*, and 211*d* extending from the interior surface 205 of the ring 201 toward the central axis A. Each of the substantially vertical baffles 211*a*, 211*b*, 211*c*, and 211*d* has a first planar surface 213*a*, 213*b*, 213*c*, and 213*d*, a second planar surface 215*a*, 215*b*, 215*c*, and 215*d*, and at least one lateral surface 217*a*, 217*b*, 217*c*, and 217*d* connecting the first planar surface 213*a*, 213*b*, 213*c*, and 213*d* and the second planar surface 215*a*, 215*b*, 215*c*, and 215*d* of each of the substantially vertical baffles 211*a*, 211*b*, 211*c*, and 211*d*, respectively. As shown in FIG. 2, each of the substantially vertical baffles 211*a*, 211*b*, 211*c*, and 211*d* is the shape of a rectangular prism and has a length such that none of the substantially vertical baffles 211*a*, 211*b*, 211*c*, and 211*d* extends above the top surface 207 of the ring 201 or below the bottom surface 209 of the ring.

Figure 3A:
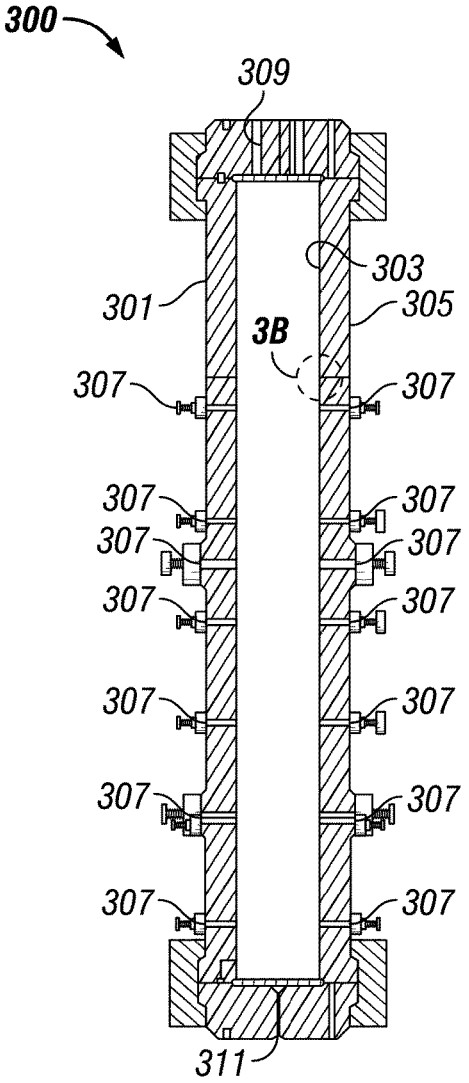
FIG. 3A illustrates a cross-sectional view of a reactor system including a partial baffle system according to an aspect of the present disclosure.
Figure 3B:
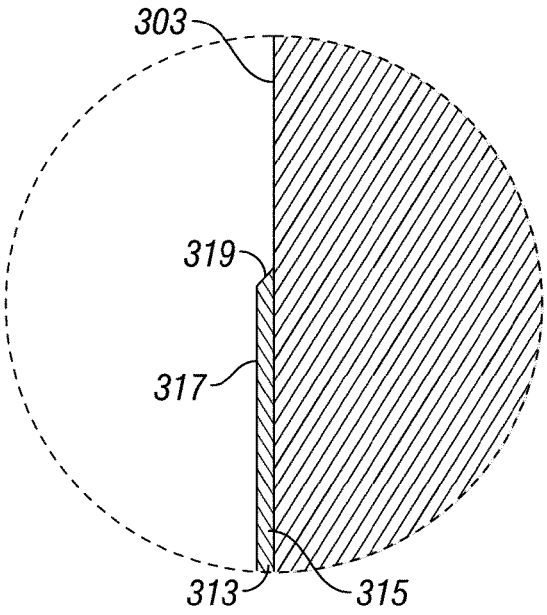
FIG. 3B illustrates a detailed view of a portion of the baffle system of FIG. 3A.
Figure 3C:
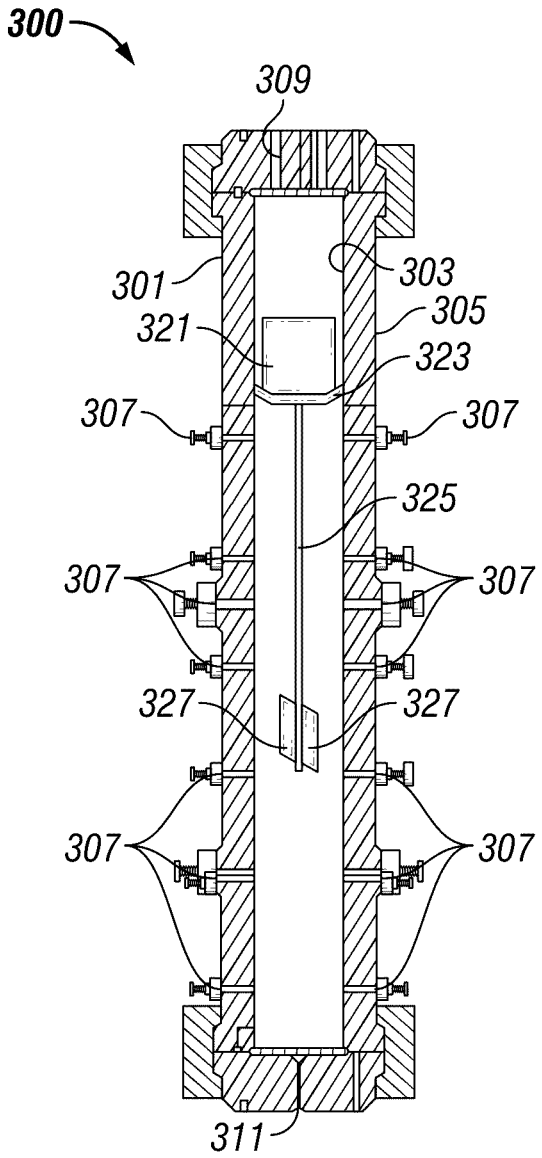
FIG. 3C illustrates a cross-sectional view of the baffle system of FIG. 3A, including a motor motor support block.

FIG. 3A illustrates a cross-sectional view of a reactor system 300 including a partial baffle system according to an aspect of the present disclosure. The reactor system 300 includes a cylindrical reactor 301 having an inner surface 303, an outer surface 305, and a plurality of measuring device ports 307. The cylindrical reactor 301 further includes a feed inlet port 309 and an outlet port 311. The reactor system 300 further includes a ring 313 having an exterior surface 315, an interior surface 317, and a top surface 319. As is illustrated in FIG. 3C, the top surface 319 serves as a ledge supporting a motor 321 and a motor support block 323. The motor 321 includes an axial shaft 325 extending vertically through the center and along the axis of the ring 313 and vanes 327 extending from the axial shaft 323. The ring 313 may further include one or more substantially vertical baffles (not shown) extending from its inner surface 317. The ring 313 can also include a rifled surface or other surface roughness treatment to enhance mixing through the reactor.

Figure 4:
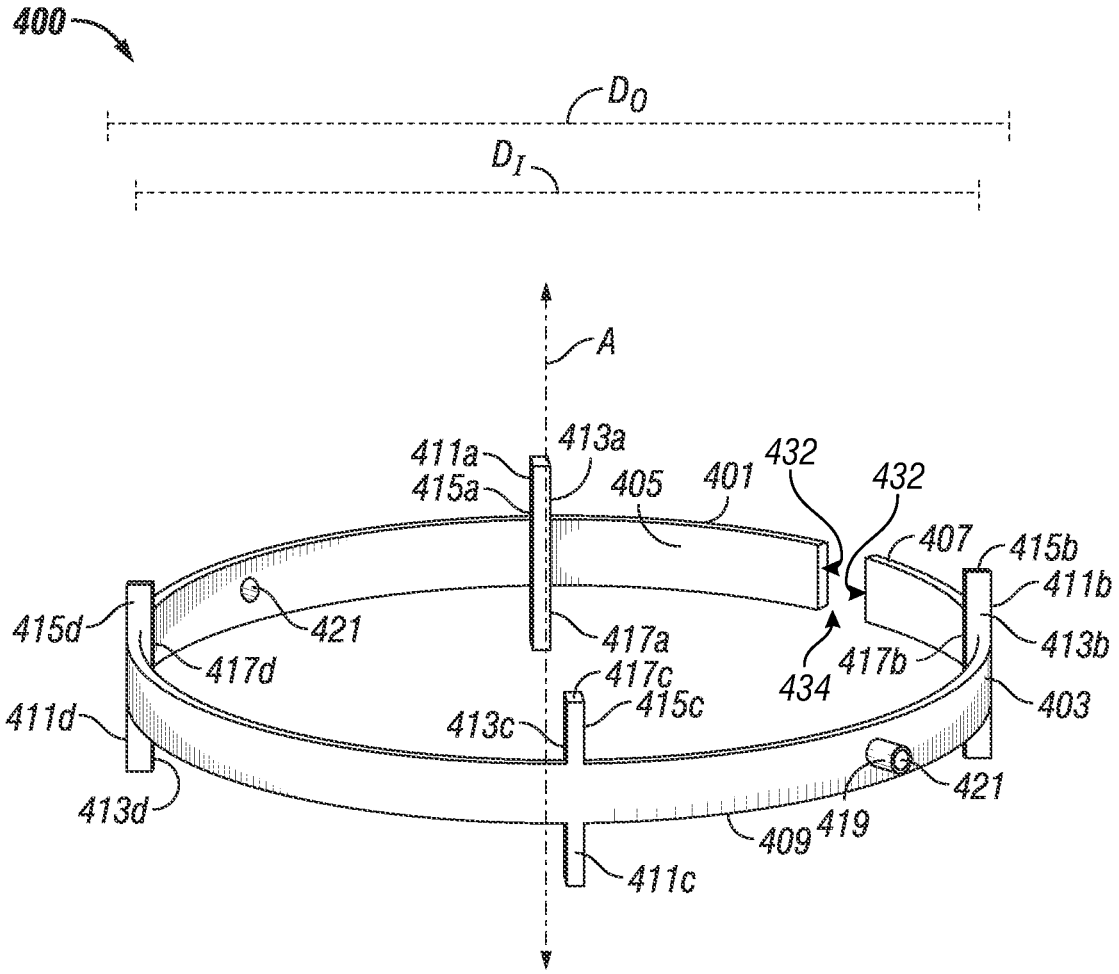
FIG. 4 illustrates a perspective view of a baffle system according to another aspect of the present disclosure.

FIG. 4 illustrates a perspective view of a baffle system 400 according to an aspect of the present disclosure. The baffle system 400 includes a discontinuous ring 401 surrounding a central axis A and having an exterior surface 403 having an outer diameter Do, an interior surface 405 having an inner diameter $D_I$, a top surface 407, a bottom surface 409. The discontinuous ring 401 is a compression ring having two opposing and non-overlying edges 432 and a gap 434 therebetween. The interior surface 405 defines an inner circumference, and the exterior surface 403 defines an outer circumference. The discontinuous ring 401 further includes projections 419 extending outwardly from the exterior surface 403, each projection 419 comprising an aperture 421 extending through the projection 419 to the interior surface 405.

The baffle system 400 further includes several substantially vertical baffles 411*a*, 411*b*, 411*c*, and 411*d* extending from the interior surface 405 of the ring 401 toward the central axis A. Each of the substantially vertical baffles 411*a*, 411*b*, 411*c*, and 411*d* has a first planar surface 413*a*, 413*b*, 413*c*, and 413*d*, a second planar surface 415*a*, 415*b*, 415*c*, and 415*d*, and at least one lateral surface 417*a*, 417*b*, 417*c*, and 417*d* connecting the first planar surface 413*a*, 413*b*, 413*c*, and 413*d* and the second planar surface 415*a*, 415*b*, 415*c*, and 415*d* of each of the substantially vertical baffles 411*a*, 411*b*, 411*c*, and 411*d*, respectively. As shown in FIG. 4, each of the substantially vertical baffles 411*a*, 411*b*, 411*c*, and 411*d* is the shape of a rectangular prism and has a length such that each of the substantially vertical baffles 411*a*, 411*b*, 411*c*, and 411*d* extends above the top surface 407 of the ring 401 and below the bottom surface 409 of the ring.

Figure 5A:
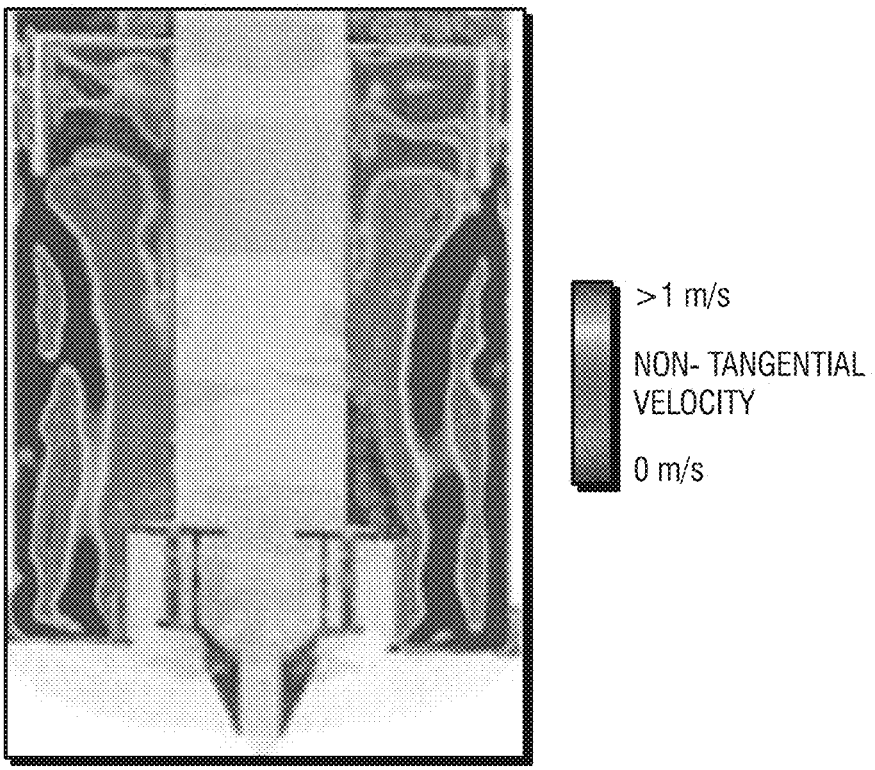
FIG. 5A is a computational fluid dynamics model of a reactor system without a baffle system.

FIG. 5A is a computational fluid dynamics model of a reactor system without a baffle system. This computational fluid dynamics model was created with ANSYS® Fluent™, version 17.0. The colored sections of the reactor correspond to sections where the fluid within the reactor is moving at a velocity according to the color scale illustrated in the figure. As can be seen from this figure, the fluid within a reactor without a baffle system as disclosed herein includes numerous areas that are stationary or exhibit a non-tangential velocity.

Figure 5B:
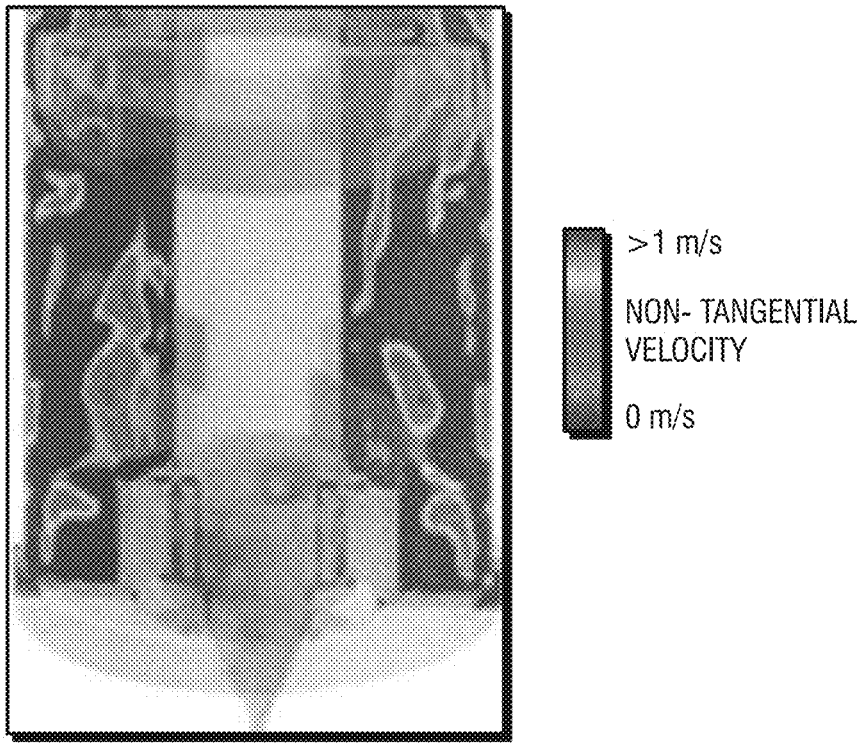
FIG. 5B is a computational fluid dynamics model of the reactor system including a baffle system according to an aspect of the present disclosure.

FIG. 5B is a computational fluid dynamics model of the reactor system including a baffle system according to an aspect of the present disclosure. The colored sections of the reactor correspond to sections where the fluid within the reactor is moving at a velocity according to the color scale illustrated in the figure. As can be seen from this figure, the fluid within a reactor with a baffle system according to an embodiment of the present disclosure includes very few areas that are stationary or exhibit a non-tangential velocity.

ASPECTS

The invention is described above with reference to numerous aspects and aspects, and specific examples. Many variations will suggest themselves to those skilled in the art in light of the above detailed description. All such obvious variations are within the full intended scope of the appended claims. Other aspects of the invention can include, but are not limited to, the following (aspects typically are described as "comprising" but, alternatively, can "consist essentially of" or "consist of" unless specifically stated otherwise)

In accordance with a first aspect of the present disclosure, a baffle system for improved mixing in a cylindrical reactor, the baffle system comprising:

a ring having an exterior surface defining an outer diameter and an outer circumference, an interior surface defining an inner diameter and an inner circumference, a top surface, a bottom surface opposite and parallel to the top surface, and an axis extending through an axial center; and one or more substantially vertical baffles extending from the interior surface of the ring toward the axis;

wherein the ring is continuous or discontinuous along the outer circumference, the inner circumference, or both the outer circumference and the inner circumference.

In accordance with a second aspect of the present disclosure, the system according to the first aspect of the present disclosure is described, wherein the one or more substantially vertical baffles each has a length which extends vertically above the top surface of ring, below the bottom surface of the ring, or both.

In accordance with a third aspect of the present disclosure, the system according to the second aspect of the present disclosure is described, wherein the one or more substantially vertical baffles are planar and comprise:

a first planar surface and a second planar surface, each of which is substantially perpendicular to the interior surface of the ring and extend in an axial direction; and at least one lateral surface connecting the first planar surface and the second planar surface.

In accordance with a fourth aspect of the present disclosure, the system according to the third aspect of the present disclosure is described, wherein the first planar surface and the second planar surface are polygonal in shape.

In accordance with a fifth aspect of the present disclosure, the system according to the fourth aspect of the present disclosure is described, wherein the first planar surface and the second planar surface are rectangular or trapezoidal in shape.

In accordance with a sixth aspect of the present disclosure, the system according to the third aspect of the present disclosure is described, wherein the first planar surface and the second planar surface include one or more rounded corners.

In accordance with a seventh aspect of the present disclosure, the system according to any one of the first to sixth aspects of the present disclosure is described, wherein the ring is a compression ring.

In accordance with an eighth aspect of the present disclosure, the system according to any one of the first to seventh aspects of the present disclosure is described, wherein the ring is an interference fit ring.

In accordance with a ninth aspect of the present disclosure, the system according to any one of the first to eighth aspects of the present disclosure is described, wherein the top surface of the ring is configured to support a mixing motor housing.

In accordance with a tenth aspect of the present disclosure, the system according to the ninth aspect of the present disclosure is described, wherein the ring is configured to extend from a bottom head of the cylindrical reactor to a motor housing of the cylindrical reactor.

In accordance with an eleventh aspect of the present disclosure, the system according to any one of the first to tenth aspects of the present disclosure is described, wherein the ring further comprises one or more openings extending from the exterior surface of the ring to the interior surface of the ring and located along the outer circumference of the ring to correspond to one or more feed inlet ports, outlet ports, or measuring device ports of the reactor.

In accordance with a twelfth aspect of the present disclosure, the system according to any one of the first to eleventh aspects of the present disclosure is described, wherein the ring further comprises one or more projections extending outwardly from the exterior surface of the ring, each projection comprising an aperture extending through the projection to the interior surface of the ring, and located along the outer circumference of the ring to correspond to and extend into one or more feed inlet ports, outlet ports, or measuring device ports of the reactor.

In accordance with a thirteenth aspect of the present disclosure, the system according to any one of the first to twelfth aspects of the present disclosure is described, wherein the ring comprises steel.

In accordance with a fourteenth aspect of the present disclosure, the system according to any one of the first to thirteenth aspects of the present disclosure is described, wherein the one or more baffles comprise steel.

In accordance with a fifteenth aspect of the present disclosure, the system according to any one of the first to fourteenth aspects of the present disclosure is described, comprising at least two vertical baffles.

In accordance with a sixteenth aspect of the present disclosure, the system according to any one of the first to fifteenth aspects of the present disclosure is described, comprising at least four vertical baffles.

In accordance with a seventeenth aspect of the present disclosure, the system according to any one of the first to sixteenth aspects of the present disclosure is described, wherein the one or more substantially vertical baffles has a length of from about 0.1 times to about 10 times the outer diameter of the ring.

In accordance with an eighteenth aspect of the present disclosure, the system according to any one of the first to seventeenth aspects of the present disclosure is described, wherein the one or more substantially vertical baffles has a length of from about 0.1 times to about 100 times the outer diameter of the ring divided by the revolutions per second made by a stirrer in the reactor.

In accordance with a nineteenth aspect of the present disclosure, the system according to any one of the first to eighteenth aspects of the present disclosure is described, wherein the ring is further configured to be attached to the cylindrical reactor in one or more of:

a bearing housing, or a motor seal block.

In accordance with a twentieth aspect of the present disclosure, the system according to the nineteenth aspect of the present disclosure is described, wherein the ring is further configured to be attached to the cylindrical reactor by one or more bolts, welding, or any combination thereof.

In accordance with a twenty-first aspect of the present disclosure, a reactor system is described comprising:

a cylindrical reactor having an inner surface and an outer surface; and the baffle system of claim 1 installed inside the reactor, such that the exterior surface of the ring is in contact with the inner surface of the reactor.

In accordance with a twenty-second aspect of the present disclosure, the system according to the twenty-first aspect of the present disclosure is described, wherein the length of the one or more substantially vertical baffles extends substantially vertically along and in contact with the inner surface of the cylindrical reactor.

In accordance with a twenty-third aspect of the present disclosure, the system according to any one of the twenty-first or twenty-second aspects of the present disclosure is described, wherein the reactor is a tubular reactor or an autoclave reactor.

In accordance with a twenty-fourth aspect of the present disclosure, the system according to any one of the twenty-first to twenty-third aspects of the present disclosure is described, wherein the reactor is a high pressure LDPE reactor.

In accordance with a twenty-fifth aspect of the present disclosure, the system according to any one of the twenty-first to twenty-fourth aspects of the present disclosure is described, wherein the ring further comprises one or more openings extending from the exterior surface of the ring to the interior surface of the ring and located along the outer circumference of the ring to correspond to one or more feed inlet ports, outlet ports, or measuring device ports of the reactor.

In accordance with a twenty-sixth aspect of the present disclosure, the system according to any one of the twenty-first to twenty-fifth aspects of the present disclosure is described, wherein the ring further comprises one or more projections extending outwardly from the exterior surface of the ring, each projection comprising an aperture and located along the outer circumference of the ring to correspond to and extend into one or more feed inlet ports, outlet ports, or measuring device ports of the reactor.

In accordance with a twenty-seventh aspect of the present disclosure, the system according to any one of the twenty-first to twenty-sixth aspects of the present disclosure is described, further comprising:

a motor comprising an axial shaft extending vertically through the center and along the axis of the ring and comprising at least two vanes extending from the axial shaft;

a feed inlet port;

an outlet port; and a measuring device port.

In accordance with a twenty-eighth aspect of the present disclosure, the system according to the twenty-seventh aspect of the present disclosure is described, wherein the at least two vanes are located vertically along the axial shaft such that at least a portion of the vanes is between the top surface and the bottom surface of the ring.

In accordance with a twenty-ninth aspect of the present disclosure, the system according to any one of the twenty-seventh or twenty-eighth aspects of the present disclosure is described, wherein the ring further comprises one or more openings extending from the exterior surface of the ring to the interior surface of the ring and located along the outer circumference of the ring to correspond to the feed inlet port, the outlet port, or the measuring device port.

In accordance with a thirtieth aspect of the present disclosure, the system according to any one of the twenty-seventh to twenty-ninth aspects of the present disclosure is described, wherein the ring further comprises one or more projections extending outwardly from the exterior surface of the ring, each projection comprising an aperture extending through the projection to the interior surface of the ring, and located along the outer circumference of the ring to correspond to and extend into one or more feed inlet ports, outlet ports, or measuring device ports of the reactor.

In accordance with a thirty-first aspect of the present disclosure, the system according to any one of the twenty-first to thirtieth aspects of the present disclosure is described, wherein each of the reactor, the ring, and the one or more substantially vertical baffles comprises steel.

In accordance with a thirty-second aspect of the present disclosure, the system according to any one of the twenty-first to thirty-first aspects of the present disclosure is described, wherein the one or more substantially vertical baffles has a length of from about 0.1 times to about 10 times the outer diameter of the ring.

In accordance with a thirty-third aspect of the present disclosure, the system according to any one of the twenty-first to thirty-second aspects of the present disclosure is described, wherein the one or more substantially vertical baffles has a length of from about 0.1 times to about 100 times the outer diameter of the ring divided by the revolutions per second made by a stirrer in the reactor.

In accordance with a thirty-fourth aspect of the present disclosure, the system according to any one of the twenty-first to thirty-third aspects of the present disclosure is described, wherein the ring is further attached to the cylindrical reactor in one or more of:

a bearing housing, or a motor seal block.

In accordance with a thirty-fifth aspect of the present disclosure, the system according to the thirty-fourth aspect of the present disclosure is described, wherein the ring is further attached to the cylindrical reactor by one or more bolts, welding, or any combination thereof.

In accordance with a thirty-sixth aspect of the present disclosure, a method of improving mixing in a gas phase, a liquid phase, a supercritical, or a slurry process, is described the method comprising:

installing a baffle system inside a substantially cylindrical reactor having an outer surface and an inner surface;

wherein the baffle system comprises:

(a) a ring having an exterior surface defining an outer diameter and an outer circumference, an interior surface defining an inner diameter and an inner circumference, a top surface, a bottom surface, and an axis, wherein the ring is continuous or discontinuous along the outer circumference, the inner circumference, or both the outer circumference and the inner circumference; and (b) one or more substantially vertical baffles extending from the interior surface of the ring toward the axis;

and wherein, when installed, the exterior surface of the ring is in contact with the inner surface of the reactor; and under gas phase, liquid phase, supercritical phase, or slurry process conditions, stirring the contents of the cylindrical reactor.

In accordance with a thirty-seventh aspect of the present disclosure, the method according to the thirty-sixth aspect of the present disclosure is described, wherein the one or more substantially vertical baffles each has a length which extends vertically above the top surface of ring, below the bottom surface of the ring, or both.

In accordance with a thirty-eighth aspect of the present disclosure, the method according to any one of the thirty-sixth or thirty-seventh aspects of the present disclosure is described, wherein the one or more substantially vertical baffles are planar and comprise:

a first planar surface and a second planar surface, each of which is substantially perpendicular to the interior surface of the ring; and at least one lateral surface connecting the first planar surface and the second planar surface.

In accordance with a thirty-ninth aspect of the present disclosure, the method according any one of the thirty-sixth to thirty-eighth aspects of the present disclosure is described, wherein the first planar surface and the second planar surface are polygonal in shape.

In accordance with a fortieth aspect of the present disclosure, the method according to any one of the thirty-sixth to thirty-ninth aspects of the present disclosure is described, wherein the first planar surface and the second planar surface are rectangular or trapezoidal in shape.

In accordance with a forty-first aspect of the present disclosure, the method according to any one of the thirty-sixth to fortieth aspects of the present disclosure is described, wherein the first planar surface and the second planar surface include one or more rounded corners.

In accordance with a forty-second aspect of the present disclosure, the method according to any one of the thirty-sixth to forty-first aspects of the present disclosure is described, wherein the ring is a compression ring.

In accordance with a forty-third aspect of the present disclosure, the method according to any one of the thirty-sixth to forty-first aspects of the present disclosure is described, wherein the ring is an interference fit ring.

In accordance with a forty-fourth aspect of the present disclosure, the method according to any one of the thirty-sixth to forty-third aspects of the present disclosure is described, wherein the top surface of the ring is configured to support a mixing motor housing.

In accordance with a forty-fifth aspect of the present disclosure, the method according to any one of the thirty-sixth to forty-fourth aspects of the present disclosure is described, further comprising the step of:

installing a motor in the substantially cylindrical reactor such that the motor rests on the top surface of the ring, the motor comprising an axial shaft extending vertically through the center and along the axis of the ring and comprising at least two vanes extending from the axial shaft.

In accordance with a forty-sixth aspect of the present disclosure, the method according to any one of the thirty-sixth to forty-fifth aspects of the present disclosure is described, wherein each of the ring, the one or more vertical baffles, and the reactor comprise steel.

What is claimed is:

1. A baffle system for improved mixing in a cylindrical reactor, the cylindrical reactor defining a reactor axis extending along a height of the cylindrical reactor, the baffle system comprising:

a cylindrical ring having an exterior surface defining an outer diameter and an outer circumference, an interior surface defining an inner diameter and an inner circumference, a top surface, a bottom surface opposite and parallel to the top surface, and an axis extending through an axial center alignable with the reactor axis; and one or more substantially vertical baffles extending from the interior surface of the ring toward the axis, wherein the ring is a compression ring which is discontinuous along both the outer circumference and the inner circumference thereby defining two opposing and non-overlying edges and a gap therebetween, wherein the ring defines a height extending between the top surface and the bottom surface in a direction along the axis, wherein the ring defines a width extending between the outer diameter and the inner diameter in a direction transverse to the axis, wherein the height of the ring is greater than the width of the ring, wherein the one or more substantially vertical baffles has a length of from about 0.1 times to about 10 times the outer diameter of the ring, wherein the one or more substantially vertical baffles has a length which extends vertically above the top surface of the cylindrical ring, vertically below the bottom surface of the cylindrical ring, or both, and wherein the one or more substantially vertical baffles are planar.

2. The baffle system of claim 1, wherein the one or more substantially vertical baffles comprise:

a first planar surface and a second planar surface, each of which is substantially perpendicular to the interior surface of the ring and extend in an axial direction; and at least one lateral surface connecting the first planar surface and the second planar surface.

3. The baffle system of claim 2, wherein the first planar surface and the second planar surface are polygonal in shape.

4. The baffle system of claim 1, wherein the top surface of the ring is configured to support a mixing motor housing.

5. The baffle system of claim 1, wherein the ring further comprises one or more openings extending from the exterior surface of the ring to the interior surface of the ring and located along the outer circumference of the ring to correspond to one or more feed inlet ports, outlet ports, or measuring device ports of the reactor.

6. The baffle system of claim 1, wherein the ring further comprises one or more projections extending outwardly from the exterior surface of the ring, each projection comprising an aperture extending through the projection to the interior surface of the ring, and located along the outer circumference of the ring to correspond to and extend into one or more feed inlet ports, outlet ports, or measuring device ports of the reactor.

7. The baffle system of claim 1, comprising at least two vertical baffles.

8. The baffle system of claim 1, comprising at least four vertical baffles.

9. The baffle system of claim 1, wherein the ring is further configured to be attached to the cylindrical reactor in one or more of:

a bearing housing, or a motor seal block.

10. A reactor system comprising:

the cylindrical reactor having an inner surface and an outer surface and defining the reactor axis; and the baffle system of claim 1 installed inside the reactor, such that the exterior surface of the ring is in contact with the inner surface of the reactor, wherein the cylindrical reactor is a high pressure LDPE reactor.

11. The reactor system of claim 10, wherein the reactor is a tubular reactor.

12. The reactor system of claim 10, further comprising:

a motor comprising an axial shaft extending vertically through the center and along the axis of the ring and comprising at least two vanes extending from the axial shaft;

a feed inlet port;

an outlet port; and a measuring device port.

13. The reactor system of claim 12, wherein the at least two vanes are located vertically along the axial shaft such that at least a portion of the vanes is between the top surface and the bottom surface of the ring.

14. The reactor system of claim 12, wherein the ring further comprises one or more openings extending from the exterior surface of the ring to the interior surface of the ring and located along the outer circumference of the ring to correspond to the feed inlet port, the outlet port, or the measuring device port.

15. The reactor system of claim 12, wherein the ring further comprises one or more projections extending outwardly from the exterior surface of the ring, each projection comprising an aperture extending through the projection to the interior surface of the ring, and located along the outer circumference of the ring to correspond to and extend into one or more feed inlet ports, outlet ports, or measuring device ports of the reactor.

16. The reactor system of claim 10, wherein the ring is further attached to the cylindrical reactor in one or more of:

a bearing housing, or a motor seal block.

17. A method of improving mixing in a gas phase, a liquid phase, a supercritical, or a slurry process, the method comprising:

installing a baffle system inside a substantially cylindrical reactor having an outer surface and an inner surface and defining a reactor axis extending along a height of the cylindrical reactor, wherein the baffle system comprises:

(a) a cylindrical ring having an exterior surface defining an outer diameter and an outer circumference, an interior surface defining an inner diameter and an inner circumference, a top surface, a bottom surface, and an axis extending through an axial center aligned with the reactor axis, wherein the ring is a compression ring which is discontinuous along both the outer circumference and the inner circumference thereby defining two opposing and non-overlying edges and a gap therebetween, and (b) one or more substantially vertical baffles extending from the interior surface of the ring toward the axis, wherein the ring defines a height extending between the top surface and the bottom surface in a direction along the axis, wherein the ring defines a width extending between the outer diameter and the inner diameter in a direction transverse to the axis, wherein the one or more substantially vertical baffles has a length of from about 0.1 times to about 10 times the outer diameter of the ring, wherein the one or more substantially vertical baffles has a length which extends vertically above the top surface of the cylindrical ring, vertically below the bottom surface of the cylindrical ring, or both, wherein the one or more substantially vertical baffles are planar, and wherein the height of the ring is greater than the width of the ring, and wherein, when installed, the exterior surface of the ring is in contact with the inner surface of the reactor; and under gas phase, liquid phase, supercritical phase, or slurry process conditions, stirring the contents of the cylindrical reactor.

18. The method of claim 17, wherein the one or more substantially vertical baffles comprise:

a first planar surface and a second planar surface, each of which is substantially perpendicular to the interior surface of the ring; and at least one lateral surface connecting the first planar surface and the second planar surface.

19. The method of claim 18, wherein the first planar surface and the second planar surface are polygonal in shape.

20. The method of claim 17, further comprising the step of:

installing a motor in the substantially cylindrical reactor such that the motor rests on the top surface of the ring, the motor comprising an axial shaft extending vertically through the center and along the axis of the ring and comprising at least two vanes extending from the axial shaft.

21. The baffle system of claim 3, wherein the first planar surface and the second planar surface are rectangular in shape.

22. The method of claim 19, wherein the first planar surface and the second planar surface are rectangular in shape.

* * * * *